US006565369B1

(12) United States Patent
Schulz et al.

(10) Patent No.: US 6,565,369 B1
(45) **Date of Patent: *May 20, 2003**

(54) BOARD-STACKING CONNECTOR

(75) Inventors: Hugo K. Schulz, Portland, OR (US); Leonard O. Turner, Vancouver, WA (US)

(73) Assignee: Intel Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 594 days.

(21) Appl. No.: 09/040,479

(22) Filed: Mar. 17, 1998

(51) Int. Cl.[7] ..... H01R 4/66
(52) U.S. Cl. ..... 439/101; 439/108; 439/608
(58) Field of Search ..... 439/79, 80, 83, 439/607–8, 629–30, 108–109, 100–101, 892, 149–150

(56) References Cited

U.S. PATENT DOCUMENTS 5,542,851 A * 8/1996 Chikano ..... 439/108
5,620,340 A * 4/1997 Andrews ..... 439/608
5,645,436 A * 7/1997 Chimizu et al. ..... 439/108
5,842,887 A * 12/1998 Andrews ..... 439/608
5,851,121 A * 12/1998 Thenaisie et al. ..... 439/63

* cited by examiner

*Primary Examiner*—Lincoln Donovan
(74) *Attorney, Agent, or Firm*—Jeffrey S. Draeger

(57) ABSTRACT

An improved stacking connector. The connector includes a plug portion and a receptacle portion. The plug portion includes a plug signal pin and a plug impedance control pin located adjacent to the plug signal pin. The receptacle portion includes a receptacle signal pin for engaging the plug signal pin when the plug portion and the receptacle portion are in a mated position. The connector also includes an impedance control shield which is located adjacent to the plug signal pin or receptacle signal pin.

25 Claims, 5 Drawing Sheets

BOARD-STACKING CONNECTOR

BACKGROUND OF THE INVENTION

1. Field of the Invention

The present invention pertains to the field of circuit board connectors. More particularly, the present invention pertains to stacking circuit board connectors for high speed signaling.

2. Description of Related Art

Improving the overall signal transfer characteristics of circuit board connectors can allow higher frequency signals to be transferred through such connectors. As a result, system level signal frequencies may be raised when an improved connector is employed in a system where the connector would otherwise limit the speed of system communication.

Stackable connectors are connectors which allow circuit boards that are substantially parallel to be connected. A cross sectional view of a ground pin of one prior art stackable connector is shown in FIG. 1. The prior art connector connects ground, power, and signal lines from one circuit board 160 to another circuit board 170 via a mating plug and receptacle arrangement. When a receptacle housing 105 engages a plug housing 100, plug pins 120 and 130 contact their respective receptacle pins 140 and 150. Although there is a gap shown beneath the plug housing 100 in this cross-sectional view, the housing 100 is typically attached to the circuit board 170 at both ends, beyond the last contact.

The pin 120 has a beam portion 122 which has a solder foot 176 extending beyond the plug housing 100 for soldering to the circuit board 170 at a solder point 172. The pin 120 is thus connected to a signal line 174 in the circuit board 170. A nib 115 may be included for some signal lines (e.g., a ground signal line) to contact an optional electromagnetic interference (EMI) shield 110 which is useful for limiting radio frequency radiation from the connector.

The pin 120 has an elongated portion 124 connected substantially perpendicular to the beam portion 122. The elongated portion extends outwardly away from a vertical center of the housing 100. A contact portion 126 is pressed against the receptacle pin 140 by an S-shaped portion 128. The second signal pin 130 is similarly configured.

The receptacle portion includes the receptacle housing 105 which supports the receptacle pins 140 and 150 as well as the optional EMI shield 110. The EMI shield 110 is also typically supported by plastic protrusions spaced along its length. The receptacle pin 140 includes a solder foot 142 which allows the contact 140 to be connected to the circuit board 160 at a solder point 162, establishing an electrical connection between the contact 140 and a signal line 166 in the circuit board 160. The receptacle pin 150 is similarly configured to make an electrical connection with a signal line 168 via the solder connection 164.

A prior art signal pin is similar to the illustrated ground pin except that there is no nib which contacts the plug pin to the optional EMI shield 110. No particular arrangement of ground and signal pins is typically required in the prior art, except when the optional EMI shield 110 is used, The EMI shield 110 is designed to contact every tenth pin, forcing that pin to be a ground pin. Thus, while the prior art allows power, ground, and signals to be transmitted between the two boards, the impedance of the signal/contact interface and the overall connector structure is not carefully controlled.

The prior art stackable connector fails to provide metal shields which surround signal pins at a desired distance to tune the characteristic impedance of the signal pin. Furthermore, the prior art does not allow ground planes to be brought sufficiently close to signal pins in stackable connectors due to the typical thickness of the housing 105 and the lack of any shielding mechanism on at least the inward side of the signal pins.

SUMMARY

An improved stacking connector is disclosed. The connector includes a plug portion and a receptacle portion. The plug portion includes a plug signal pin and a plug impedance control pin located adjacent to the plug signal pin. The receptacle portion includes a receptacle signal pin for engaging the plug signal pin when the plug portion and the receptacle portion are in a mated position. The connector also includes an impedance control shield which is located adjacent to the plug signal pin or the receptacle signal pin.

BRIEF DESCRIPTION OF THE FIGURES

The present invention is illustrated by way of example and not limitation in the figures of the accompanying drawings.

DETAILED DESCRIPTION

The present disclosure describes an improved board-stacking connector. In the following description, numerous specific details such as pin shapes, shield shapes, distances between pins and shields, and impedance values are set forth in order to provide a more thorough understanding of the present invention. It will be appreciated, however, by one skilled in the art that the invention may be practiced without such specific details.

The described impedance controlled connector may allow higher speed signals to be transferred between circuit boards or other electronic components. Ground pins and front and/or rear shields may provide a specific desired impedance in some embodiments. Such impedance may be tuned by controlling the distance and/or material between these various metal surfaces and the pins carrying signals.

Figure 2:
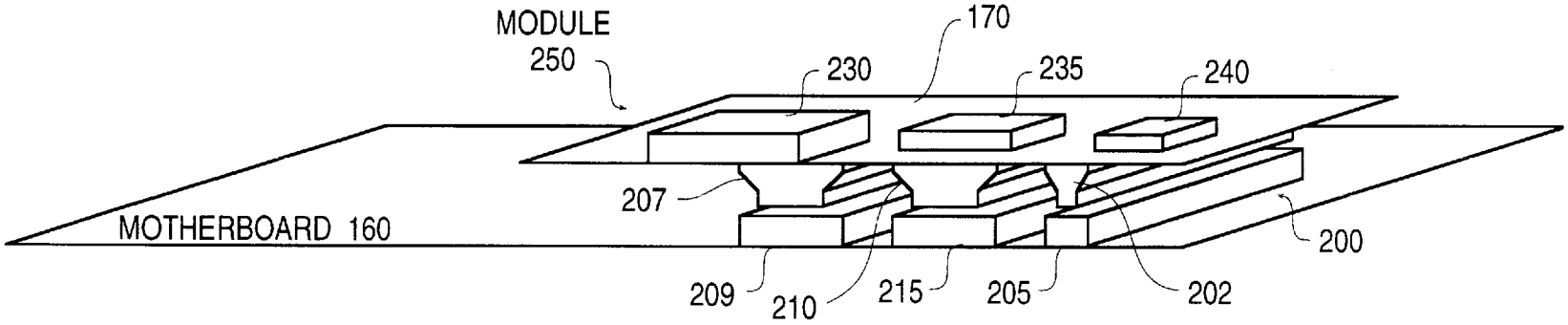
FIG. 2 illustrates one embodiment of a system which utilizes an impedance controlled connector.

FIG. 2 illustrates one embodiment of a system utilizing an impedance controlled stacking connector. A motherboard 160 and a module 250 are electrically coupled by three connectors. In the illustrated embodiment, the module 250 includes a processor 230, a bus controller 235, and a cache circuit 240 mounted on the circuit board 170.

As illustrated, the "module" 250 is a smaller card which interfaces with a larger motherboard 160. In other embodiments any two sizes of circuit boards or modules may be connected using connectors of the present invention alone and/or with connectors known in the prior art. Additionally, the locations of the plug and receptacle connectors may be swapped. Furthermore, the impedance controlled connector may be used to couple any other type of electronic component.

In the illustrated embodiment, prior art receptacles 209 and 215 are mounted on the motherboard 160 and interface with prior art plugs 207 and 210. These connectors may be prior art connectors such as that shown in FIG. 1 and therefore may carry a number of signals which are not the fastest switching signals communicated between the motherboard 160 and the module 250.

The impedance controlled connector 200 includes the plug portion 202 and the receptacle connector portion 205 which form a connection with controlled impedance for high speed signals. The impedance controlled connector 200 includes signal lines disposed in a row with impedance control pins interspersed throughout the row. In one embodiment, the impedance control pins are grounded; however, these pins may be otherwise biased in other embodiments.

In one embodiment, the impedance is approximately 28 ohms to accommodate a bus design such as a Rambus bus designed by Rambus Corporation of Mountain View, Calif. In this embodiment, the module 250 is a processor module which includes a bus controller 235 and cache circuit 240. The bus controller 235 communicates with a memory subsystem (not shown) on the motherboard by passing a number of signals from the bus controller 235 to the memory through the impedance controlled connector 200 of the present invention.

Figure 3:
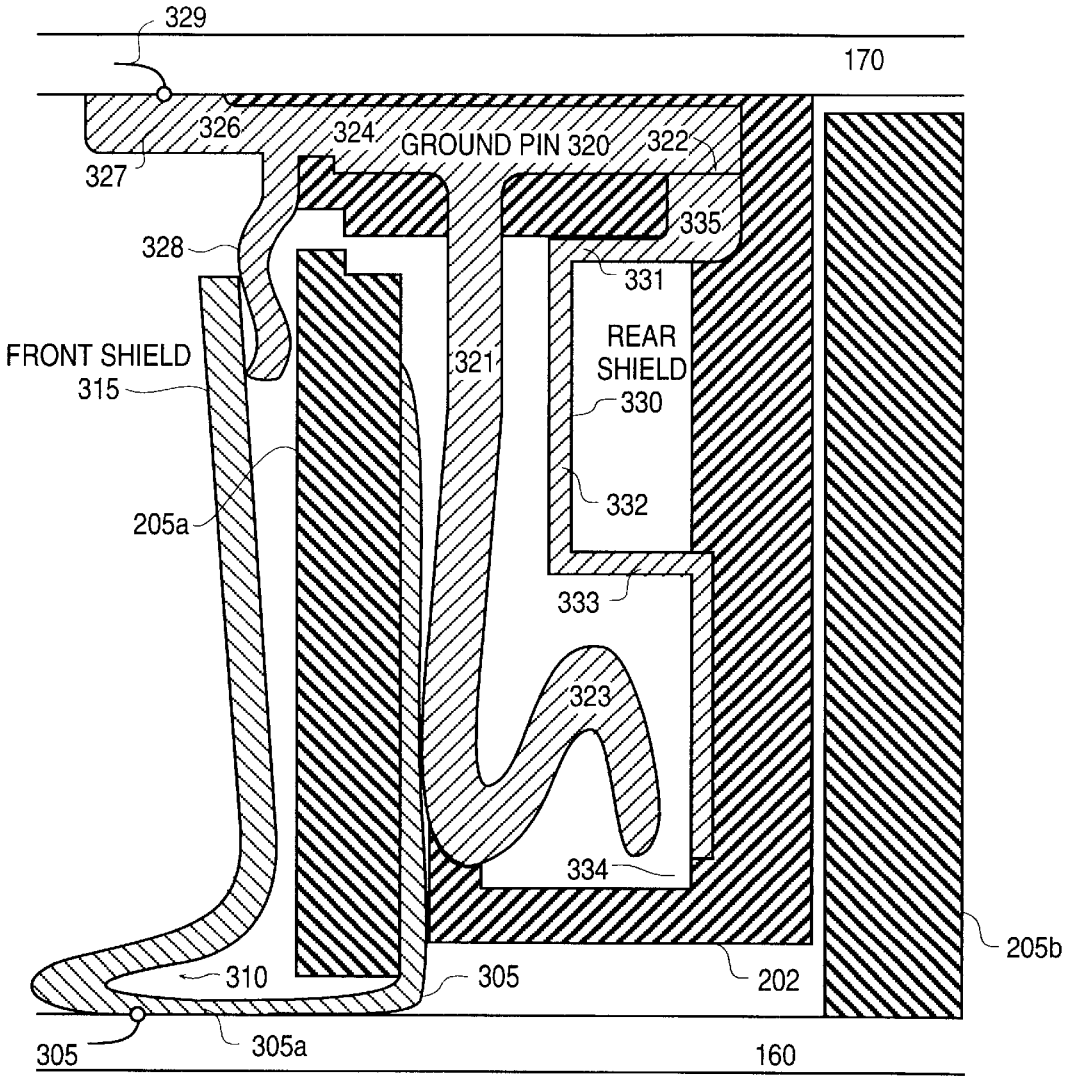
FIG. 3 illustrates one embodiment of mating ground pins utilized in an impedance controlled connector.

A cross sectional view of one embodiment of a connector of the present invention illustrating an impedance control pin (i.e., in this embodiment a ground pin) is shown in FIG. 3. This connector 200 includes a plug housing 202 connected to the circuit board 170 and a receptacle housing having a frontal housing 205*a* and a rear housing 205*b* connected to the motherboard 160.

The ground pin 320 shown in FIG. 3 has essentially the same cross sectional view as did prior art pins. The ground pin 320 includes a beam portion 324, an elongated portion 321 which is attached to the beam portion 324 at a first end and which is substantially perpendicular to the beam portion 324. An S-shaped portion 323 of the pin 320 begins at a second end of the elongated portion 321, and the ground pin 320 is urged against a contact 305 when the plug portion and receptacle portion of the connector are in a mated position. The shape of the ground pin 320 is not crucial to the present invention as long as a connection may be made with the contact 305. Utilizing the same general pin shape for ground pins and signal pins, however, may be advantageous for manufacturing purposes.

The beam portion 324 of the ground pin also has a solder foot 326 which connects the ground pin 320 to a signal line 329 in the circuit board 170 via a solder connection 327. Furthermore, the ground pin 320 includes a nib 328 extending from the solder foot 326. In alternative embodiments, the nib 328 may be omitted entirely or may extend from the beam portion 324 in a different configuration that still contacts a front shield 315.

The beam portion 324 of the ground pin 320 differs from the prior art pin in that it has a connecting surface 322 disposed at one end. The connecting surface contacts an impedance control shield, rear shield 330. The rear shield 330 is a conductive plate (e.g., copper, aluminum, or any other conductive metal) which assists in controlling the impedance of any adjacent pin. As illustrated, the ground pin 320 and the rear shield 330 are connected together. Both assist in tuning the impedance of signal pins which are on either lateral side (i.e., from the perspective shown, in front or in back of the ground pin 320).

Figure 4:
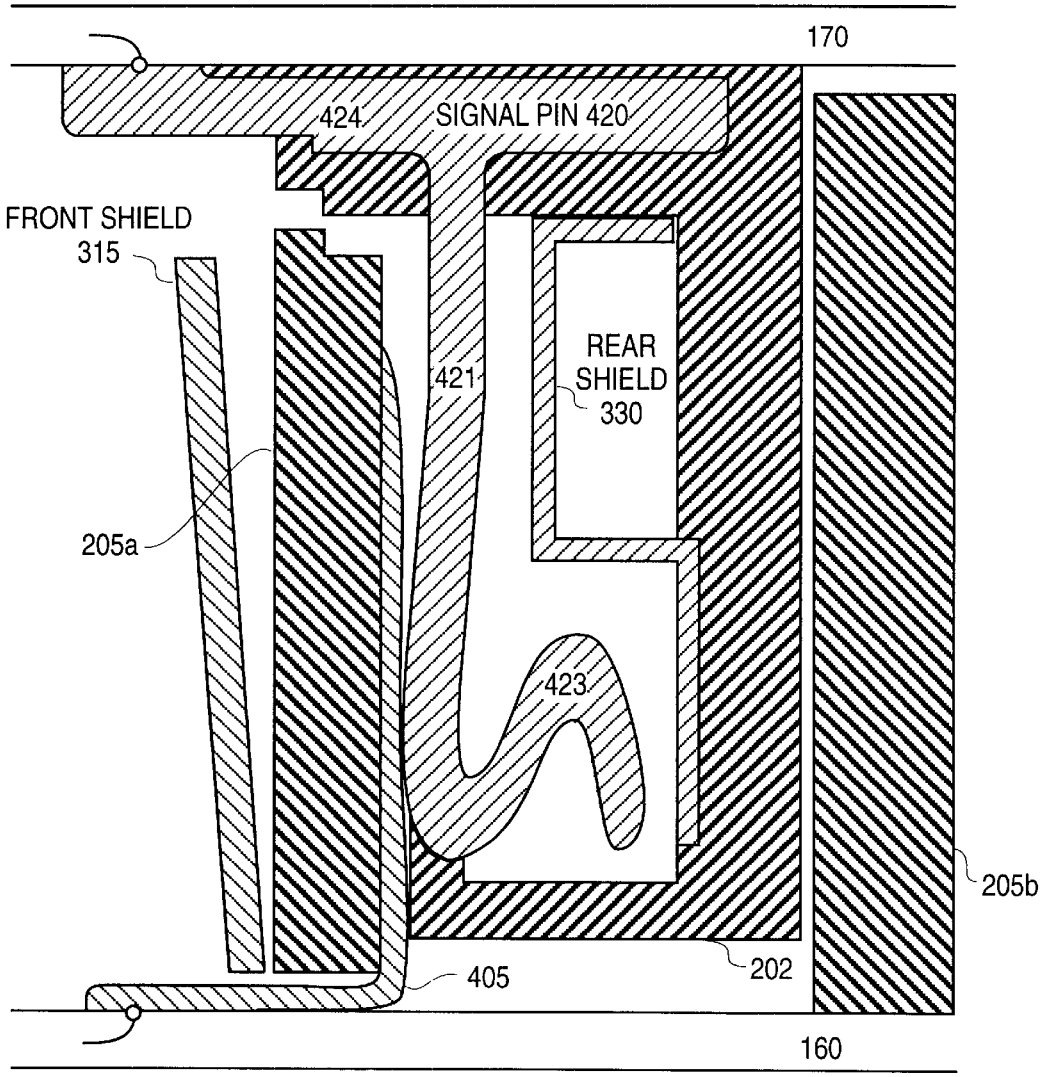
FIG. 4 illustrates one embodiment of mating signal pins utilized in an impedance controlled connector.

The rear shield 330 conforms roughly to the shape of the ground pin (and/or more importantly, a signal pin 420 shown in FIG. 4). The rear shield 330 includes a contacting portion 335 which contacts the connecting surface 322 of the beam portion 324. The S-shape of the pin 320 complicates the shield design; however, this complication is alleviated somewhat by the fact that it is not crucial that the rear shield 330 exactly conform to the shape of the pin 320. Furthermore, if the plug ground pins are shaped differently than the plug signal pins, the rear shield 330 may only conform to the shape of the plug signal pins and may not at all conform to the shape of the plug ground pins.

In the illustrated embodiment, the rear shield 330 has four portions, a first horizontal portion 331 connected to the contacting portion at a first end, a first vertical portion 332 connected to a second end of the first horizontal portion 331, a second horizontal portion 333 connected to a second end of the first vertical portion 332, and a second vertical portion 334 connected to a second end of the second horizontal portion 333. Thus, a relatively small spacing is provided between the pin 320 and the rear shield. In some embodiments, an insulating material may be placed in the gap. Insulating material with a specific dielectric constant may be chosen to achieve a specific impedance.

The nib 328 differs from the prior art nib in that it contacts an impedance control shield, front shield 315. In the prior art, an EMI shield may have been used with some connectors; however, such prior art shields are located too far from the pin 320 (i.e., the frontal housing 205*a* is too thick) for such shields to effectively control pin impedance. The nib 328 may be omitted in some embodiments if other contacts to the front shield 315 (e.g., the contact 305) provide sufficient electrical conductivity to control pin impedance.

Additionally, in this embodiment, the contact 305 includes not only the contact 305 and solder foot 305*a* used in the prior art, but also a bent portion 310 which causes the contact 305 to be an integral part of the front shield 315. This additional contact to the front shield 315 assures that the front shield is properly biased (e.g., at ground) to evenly affect the impedance of the pins in the connector. The contact 305 may include an integral bent portion 310 and front shield contact as shown or may be divided into separate portions which are soldered or otherwise coupled.

Figure 5:
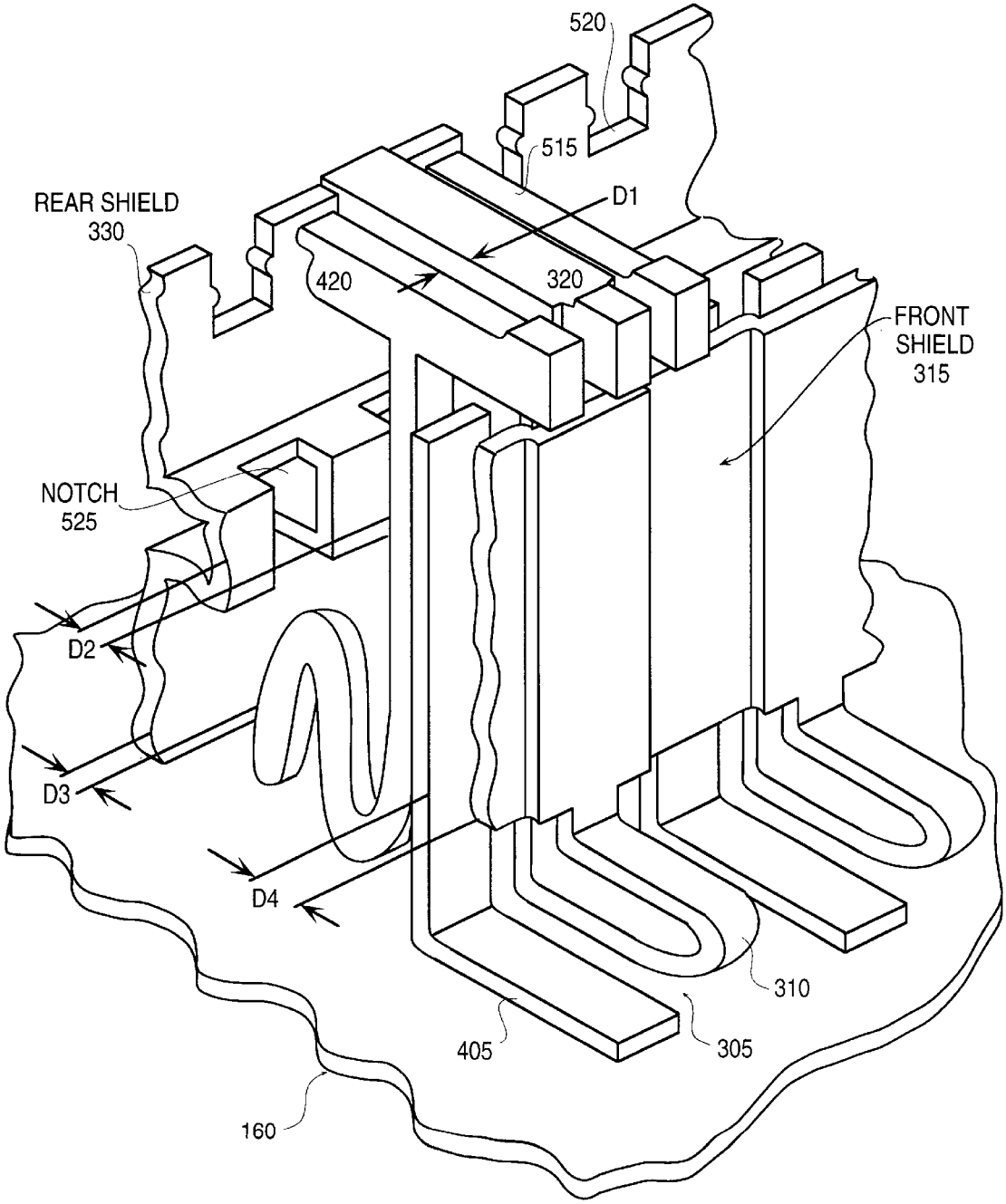
FIG. 5 is a cutaway perspective view of one embodiment of an impedance controlled connector.

The ground pin 320 also differs from prior art pins in that it may be made of a thicker or thinner metal than prior art signal pins. As is shown in FIG. 5, the ground pin 320 is thicker than prior art pins, resulting in the grounded surface being closer to adjacent signal pins. This closer grounded metal improves the ability to control the impedance of the signal pins.

FIG. 4 illustrates one embodiment of a signal pin 420. In contrast to the ground pin, the signal pin 420 may be thinner than the ground pin 320. Additionally, the signal pin 420 does not have a connection between its beam portion 424 and the rear shield 330, it does not have a nib connecting the signal pin 420 to the front shield 315, and it does not have a connection between the contact 405 and the front shield 315.

As a result, the signal pin is isolated from the front shield 315, the rear shield 330, and surrounding ground pins. In one embodiment, the connector includes ground pins such as the ground pin 320 on each lateral side of the signal pin 420. In other words, the connector forms a row of alternating signal pins and ground pins. At the ends, ground pins are employed such that each signal pin has ground pins on both sides. Alternative embodiments include other arrangements of signal pins with impedance control pins such as ground pins interspersed. For example, alternate embodiments may utilize ground pins every two or three signal pins.

Figure 1:
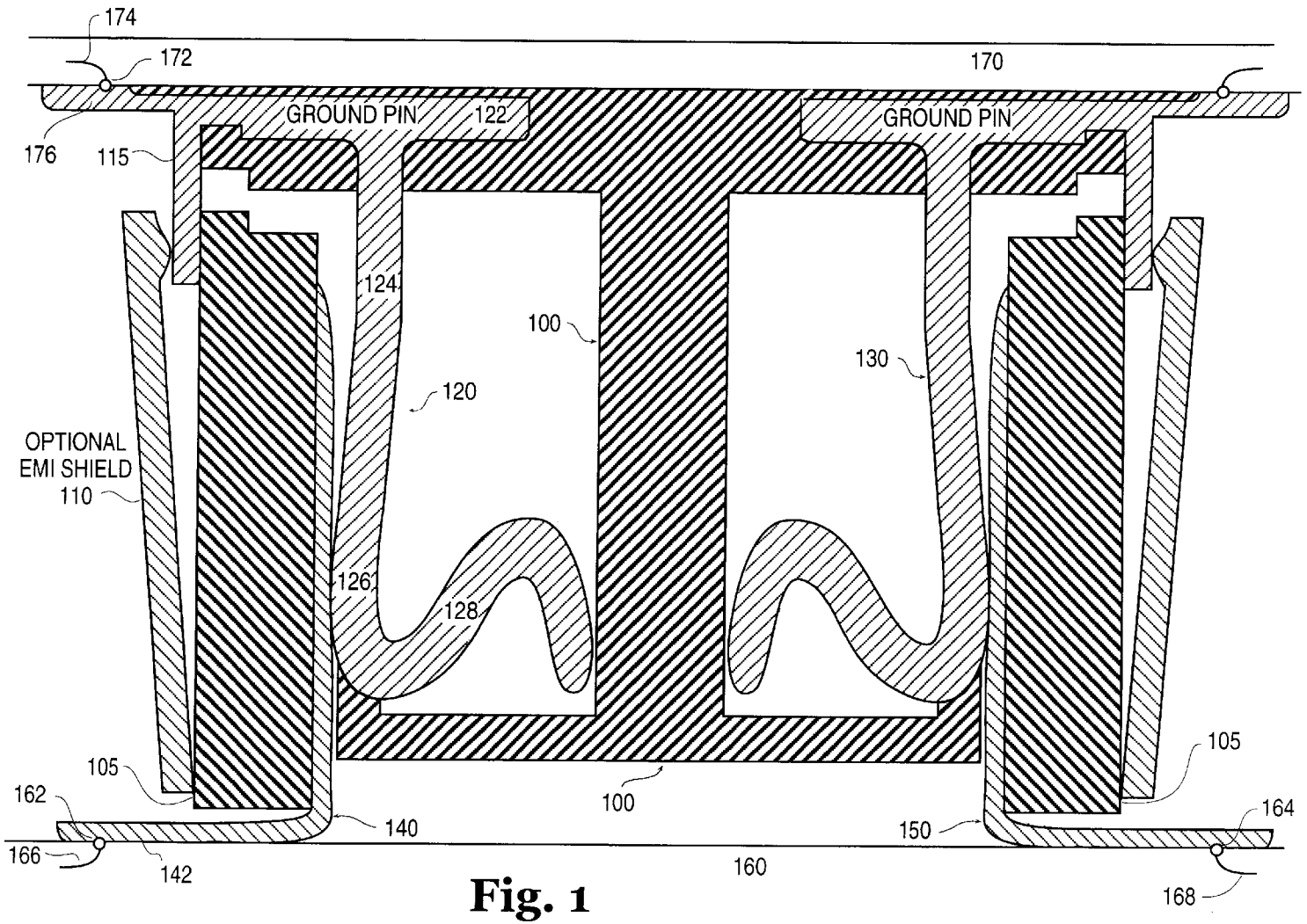
Fig. 1 (Prior Art)
FIG. 1 illustrates a prior art stackable connector.

Furthermore, although the connector of FIGS. 3 and 4 is illustrated as a single sided connector (i.e., unlike the prior art connector shown in FIG. 1, there is only one row of pins). An alternative embodiment of the present invention may utilize a double sided connector with a mirror image of the structure shown in FIGS. 3 and 4 being used to form the second row. If rear shields are used in both halves, however, the connector may be wider than those utilized in the prior art.

The signal pin 420 includes beam, elongated, and S-shaped portions respectively 424, 421, and 423 shaped similarly to those of the ground pin 320 in FIG. 3. The rear shield 330 conforms approximately to the signal pin shape and runs along the entire connector row in parallel to the front shield 315. The front shield 315 in close proximity to the receptacle signal pin 405 (although the frontal housing 205*a* separates the receptacle signal pin 405 and the front shield 315). In the embodiment where signal pins and ground pins alternate, each signal pin is surrounded on all four sides by grounded (or otherwise biased) metal. By controlling the spacing and/or the material between these adjacent metal pieces, a desired impedance or impedance range may be achieved.

FIG. 5 illustrates a portion of one embodiment of an impedance controlled connector of the present invention. As shown in FIG. 5, the plug ground pin 320 from FIG. 3 and the plug signal pin 420 from FIG. 4 are adjacent. An additional signal pin 515 is shown on the other side of the ground pin 320, and in the illustrated embodiment, the ground pin 320 is thicker than the signal pins 420 and 515. In alternative embodiments, the spacing between ground and signal pins may be changed such that all pins are of uniform width. Additionally, the signal pins could be wider than the ground pins in order to achieve a particular spacing which corresponds to a desired impedance.

Also shown are the front shield 315 as well as the receptacle ground pin 305 which forms an integral part with the bent portion 310 of the front shield 315. The bent portion 310 becomes the solder foot which attaches the ground pin 305 to the circuit board 160 (see also 305*a* in FIG. 3). As illustrated the front shield 315 is at a particular distance from the receptacle signal pin 405 and runs substantially parallel to the row of pins and contacts.

A contact notch 520 engages a ground pin to provide electrical contact to the rear shield 330. Such contact notches allow plug ground pins to establish electrical contact to the rear shield 330 as the plug ground pins are press fit or otherwise assembled during manufacture. Additionally, an optional insertion notch 525 may be provided to allow the ground pins to be pressed into place in the rear shield 330 from above after the rear shield 330 is installed. The insertion notch 525 near the plug ground pins still allows the metal surface of the rear shield 330 to be adjacent to all plug signal pins as there is no insertion notch for the plug signal pins. The plug signal pins do not need to be press fit from above into insertion notches on the rear shield 330.

In one embodiment, the connector is tuned to achieve an impedance of approximately 28 ohms. In this embodiment, the distance between adjacent ground and signal pins of the plug is approximately 0.010 inches (labeled D1), the distance between the elongated portion of the signal pin 420 and the rear shield is approximately 0.010 inches (labeled D2), the distance between the second vertical portion of the rear shield 330 and the S-shaped portion of the signal pin 420 is approximately 0.010 inches (labeled D3), and the distance between the front shield and the contact 405 is approximately 0.010 inches (labeled D4).

As far as the board-to-board stacking heights (i.e., the gap between the circuit boards 160 and 170), different embodiments of the present invention may have different heights. For example, a 4 millimeter, 6, millimeter, or 8 millimeter gap may be used. A constant 28 ohm characteristic impedance may be provided for a particular desired height by adjusting the distance between the signal pins and the surrounding metal and/or by introducing an intervening material with a particular dielectric constant to tune the impedance.

Thus, an improved board-stacking connector is described. While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art upon studying this disclosure.

What is claimed is:

1. A connector comprising:

a plug portion comprising a plug signal pin;

a plug impedance control pin located adjacent to the signal pin, the plug impedance control pin and the plug signal pin being similarly sized and shaped;

a receptacle portion comprising a receptacle signal pin for engaging the plug signal pin when the plug portion and the receptacle portion are in a mated position; and an impedance control shield located adjacent to the plug signal or the receptacle signal pin.

2. The connector of claim 1 wherein the plug impedance control pin is a first impedance control pin and wherein the plug portion further comprises:

a second impedance control pin located adjacent to the plug signal pin on a lateral side opposite the first impedance control pin.

3. The connector of claim 2 wherein the impedance control shield is a first impedance control shield which is located adjacent to a front edge of the receptacle signal pin, the plug portion further comprising:

a second impedance control shield located adjacent to a rear edge of the plug signal pin.

4. The connector of claim 3 wherein the first impedance control pin, the second impedance control pin, the first impedance control shield, and the second impedance control shield are positioned to provide a target impedance for the signal pin.

5. The connector of claim 4 wherein the target impedance is 28 ohms.

6. The connector of claim 4 wherein the plug impedance control pin has a plug impedance control pin thickness and the plug signal pin has a plug signal pin thickness and wherein the plug impedance control pin width is different than the plug signal pin width.

7. The connector of claim 3 wherein the plug signal pin has a beam portion, an elongated portion having a first end attached to the beam portion and being substantially perpendicular to the beam portion, and an S-shaped portion at a second end of the elongated portion and wherein the second impedance control shield is shaped to approximately conform to the signal pin.

8. The connector of claim 3 wherein the receptacle portion further comprises:

a receptacle impedance control pin which mates with the plug impedance control pin when the plug portion and the receptacle portion are in the mated position and which is connected to the first impedance control shield.

9. The connector of claim 8 wherein the plug impedance control pin includes an elongated portion, a beam portion affixed substantially perpendicular to the elongated portion, and a nib portion, the nib portion being positioned to contact the first impedance control shield when the plug portion and the receptacle portion are in the mated position.

10. A connector comprising:

a plug portion comprising a plurality of plug impedance control pins;

a plurality of plug signal pins each having one of the plurality of plug impedance control pins on each lateral side, the plurality of plug impedance control pins and the plurality of plug signal pins being similarly sized and shaped;

a receptacle portion comprising a plurality of receptacle signal pins each having a contact edge for engaging one of the plurality of plug signal pins, the plurality of receptacle pins being disposed along an engaging edge of the receptacle portion;

a plurality of receptacle impedance control pins each having a contact edge for engaging one of the plurality of plug impedance control pins a front shield affixed adjacent to a non-contact edge of each of the plurality of receptacle impedance control contacts and the plurality of receptacle signal pins.

11. The connector of claim 10 wherein the plug portion further comprises:

a rear shield affixed substantially parallel to the front shield such that the rear shield is adjacent to a non-contact edge of each of the plurality of plug signal pins when the plug portion of the connector engages the receptacle portion of the connector.

12. The connector of claim 11 wherein each of the plurality of plug signal pins and each of the plurality of plug impedance control pins has a beam portion, an elongated portion having a first end attached to the beam portion and being substantially perpendicular to the beam portion, and an S-shaped portion at a second end of the elongated portion and wherein the rear shield is shaped to approximately conform to the plurality of plug signal pins and the plurality of plug impedance control pins.

13. The connector of claim 12 wherein the rear shield comprises:

a first horizontal portion adjacent to the beam portion of each of the impedance control and signal pins;

a first vertical portion having a first end connected to the first horizontal portion, the vertical portion being adjacent to the elongated portion of each of the plug impedance control and signal pins;

a second horizontal portion having a first end connected to a second end of the first vertical portion, the second end being adjacent to a portion of the S-shaped portion of each of the plug impedance control and signal pins; and a second vertical portion having a first end connected to a second end of the second horizontal portion, the second vertical portion being adjacent to another portion of the S-shaped portion of each of the plug impedance control and signal pins.

14. The connector of claim 10 wherein the front shield is attached to each one of the plurality of plug impedance control pins.

15. A module comprising:

an electronic component coupled to a plurality of signal lines;

a connector coupled to the plurality of signal lines, the connector comprising a plurality of impedance control pins positioned in a row; and a plurality of signal pins coupled to the plurality of signal lines, each of the plurality of signal pins having one of the plurality of impedance control pins on each lateral side, the plurality of impedance control pins and the plurality of signal pins being similarly sized and shaped.

16. The module of claim 15 wherein the module is a processor module.

17. The module of claim 15 wherein the module is a motherboard of a computer system.

18. The module of claim 15 further comprising:

at least one impedance control shield positioned parallel to the row of signal contacts.

19. The module of claim 15 wherein the plurality of impedance control pins are plug impedance control pins, the plurality of signal pins are plug signal pins, and a plug housing supports the plurality of plug impedance control pins and the plurality of signal pins.

20. The module of claim 15 wherein the plurality of impedance control pins are receptacle impedance control pins, the plurality of signal pins are receptacle signal pins, and a receptacle housing supports the plurality of receptacle impedance control pins and the plurality of receptacle pins.

21. The module of claim 15 wherein the module is a motherboard in a computer system.

22. An apparatus comprising:

a first circuit board comprising:

an electronic component coupled to a first plurality of signal lines;

a second circuit board comprising:

an electronic component coupled to a second plurality of signal lines;

a connector connecting the first plurality of signal lines to the second plurality of signal lines, the connector comprising:

a first plurality of signal pins coupled to one of the first and second plurality of signal lines;

a second plurality of signal pins coupled to the other of the first and second plurality of signal lines, the first and second plurality of signal pins forming a row when engaged;

a plurality of impedance control pins interspersed in the row formed by the signal pins, the impedance control pins and the signal pins being similarly sized and shaped; and an impedance shield positioned parallel to the row formed by the signal pins.

23. The apparatus of claim 22 wherein the connector further comprises:

a second impedance shield positioned parallel to the row formed by the signal pins, the second impedance shield conforming to a pin shape of the plurality of signal pins.

24. The apparatus of claim 22 wherein the first circuit board is a processor module, the second circuit board is a system motherboard.

25. An apparatus comprising:

a plug portion comprising:

a first plurality of signal pins;

a first plurality of impedance control pins, each of the plurality of signal pins having one of the plurality of impedance control pins on each lateral side;

a receptacle portion comprising:

a second plurality of receptacle signal pins;

a second plurality of impedance control pins, each of the plurality of signal pins having one of the plurality of impedance control pins on each lateral side; and a front impedance control shield;

a rear impedance control shield.

* * * * *